US007513446B2

(12) United States Patent
Young et al.

(10) Patent No.: US 7,513,446 B2
(45) Date of Patent: Apr. 7, 2009

(54) SYSTEM WITH REMOTE VISUAL INDICATION OF OUTPUT MATERIAL SIZE SETTING FOR A JAW-TYPE ROCK CRUSHER

(75) Inventors: Gregory A. Young, Cedar Rapids, IA (US); Steven A. Reicks, Solon, IA (US)

(73) Assignee: Cedarapids, Inc., Cedar Rapids, IA (US)

( * ) Notice: Subject to any disclaimer, the term of this patent is extended or adjusted under 35 U.S.C. 154(b) by 0 days.

(21) Appl. No.: 12/030,378

(22) Filed: Feb. 13, 2008

(65) Prior Publication Data

US 2008/0164353 A1 Jul. 10, 2008

Related U.S. Application Data

(62) Division of application No. 11/079,352, filed on Mar. 14, 2005, now Pat. No. 7,344,097.

(51) Int. Cl.
*B02C 1/02* (2006.01)

(52) U.S. Cl. ..... 241/30; 241/37; 241/101.3; 241/268

(58) Field of Classification Search ..... 241/264–268, 241/101.3, 169.1, 30, 37
See application file for complete search history.

(56) References Cited

U.S. PATENT DOCUMENTS 3,976,255 A 8/1976 Edwards
4,361,289 A 11/1982 Georget
4,591,104 A * 5/1986 Bounds ..... 241/169.1
4,637,562 A 1/1987 Hagiwara
4,749,132 A 6/1988 Hagiwara
4,783,013 A 11/1988 Polzin
4,927,089 A 5/1990 Altmayer
5,397,069 A 3/1995 Kitsukawa et al.
5,765,769 A 6/1998 Kaya
5,769,334 A 6/1998 Nakayama
5,799,888 A 9/1998 Hamaguchi
5,857,630 A 1/1999 Hamaguchi
6,116,530 A 9/2000 Altmayer
6,375,105 B1 4/2002 Haven
6,619,576 B2 9/2003 Togashi
6,644,577 B2 11/2003 Togashi
6,668,712 B1 12/2003 Gervais
7,344,097 B2 3/2008 Young

OTHER PUBLICATIONS

Pages from manual of Automatic Welding Machine & Supply Co. for "Installation & Operations Manual for Tension Rod Cylinders".
Applicant admitted prior art—Nordberg C-Jaw Crushers—2 pages attached.
Applicant admitted prior art—Telsmith 3858 Jaw Crusher.
Applicant admitted prior art—Terex Jaw Crusher Jaques JW3042.

* cited by examiner

*Primary Examiner*—Mark Rosenbaum
(74) *Attorney, Agent, or Firm*—Simmons Perrine Moyer Bergman PLC

(57) ABSTRACT

A jaw crusher where the tension rod includes an electronically-controlled hydraulic pre-load and an automatically releasable pre-load whenever adjustments to the size of the material output are made, together with a remote visual indicator of the setting of the size of the material output.

18 Claims, 6 Drawing Sheets

SYSTEM WITH REMOTE VISUAL INDICATION OF OUTPUT MATERIAL SIZE SETTING FOR A JAW-TYPE ROCK CRUSHER

CROSS REFERENCE TO RELATED APPLICATIONS

This application is a divisional application of application Ser. No. 11/079,352 filed on Mar. 14, 2005, by the same inventors, and entitled "Jaw-Type Rock Crusher with Toggle Plate Tension Bar". This application is incorporated herein in its entirety by this reference. This application is also related to application Ser. No. 12/019,436 filed on Jan. 24, 2008, which is a continuation of application Ser. No. 11/079,352.

FIELD OF THE INVENTION

The present invention generally relates to jaw-type rock crushers, and more particularly relates to jaw crushers having a toggle plate and spring tension rod, and even more particularly relates to such spring tension rods with hydraulics.

BACKGROUND OF THE INVENTION

In the past, rock crusher designers have endeavored to improve the ease of operating and adjustment of jaw-type rock crushers. While many improvements have been made to reduce the effort associated with adjusting such crushers, adjustment of such crushers often remains a non-trivial task. Most jaw-type crushers usually have a fixed jaw and a large heavy movable jaw known as a pitman which is driven by an eccentric shaft which causes the pitman to move along a non-circular path.

Typically, the bottom of the pitman is supported by a piece of metal called the toggle plate. It serves the purpose of allowing, within limits, the bottom of the pitman to move up and down with the motion of the eccentric shaft, as well as serve as an overload protection mechanism for the entire crusher. Should a piece of non-crushable material such as a steel loader tooth (sometimes called "tramp iron") enter the jaw of the crusher and be larger than the maximum allowed size for passing through the jaw (the output material size setting), it can't be crushed nor pass through the jaw. In this case, the toggle plate is designed to collapse and prevent further damage to the rest of the crusher.

Adjustment of the location of the toggle plate effectively adjusts the output material size setting. A common approach to adjusting the location of the toggle plate is to use a pair of reversed overlapping wedges which are hydraulically actuated so that when maximum overlap occurs, the output material size setting is at a minimum.

A tension rod is typically included to maintain contact between the pitman and the movable toggle plate in an effort to reduce wear on these components.

These tension rods have various types of construction. One type of tension rod used in the past has been a spring coupled to a threaded rod and nut combination. Adjustment of the nut can adjust the tension applied. Others have used hydraulic cylinders with an accumulator to essentially effectuate an adjustable "hydraulic spring." Other hybrid designs have used hydraulic or pneumatic power to maintain a constant pressure applied to a spring.

While these and other types of tension rods have improved the operation of a jaw crusher, they do have several drawbacks.

First of all, all types of spring-loaded tension rods generally make it more difficult to manipulate the overlapping wedges due to the high spring forces.

The hydraulic cylinder with an accumulator often results in leakage at the hydraulic seal owing to the very rapid movement of the tension rod.

The hybrid types of tension rods may require a manual release of the hydraulic pressure therein to reduce the pressure, thereby making it easier to manipulate the overlapping wedges.

Consequently, there exists a need for improved methods and systems for tensioning a toggle plate and a pitman in an efficient manner.

SUMMARY OF THE INVENTION

It is an object of the present invention to provide a system and method for adjusting the output material size setting and maintaining the tension between a pitman and a toggle plate of a jaw-type rock crusher in an efficient manner.

It is a feature of the present invention to utilize a hydraulic pre-loaded spring tension rod.

It is an advantage of the present invention to provide an easily adjustable spring tension rod that provides a constant (within limits) tension between the toggle plate and the pitman irrespective of the output material size setting of the crusher.

It is another feature of the present invention to include a pressure sensing device to create an electronically controlled hydraulic system which maintains the pressure within the hydraulic cylinder portion of the tension rod within predetermined limits.

It is another advantage to permit automatic re-pressurization of the hydraulic pre-load within predetermined limits.

It is yet another advantage of the present invention to permit automatic shutdown of the crusher if the pressure of the hydraulic pre-load is improperly set to an excessively high level.

It is another feature of the present invention to include an automatic reduction in the hydraulic pre-load pressure whenever the overlapping wedges are being manipulated to change the output material size setting of the crusher.

It is another advantage of the present invention to permit easier adjustment of the output setting of the crusher, thereby allowing smaller and more compact hydraulic cylinders to manipulate the overlapping wedges.

It is yet another feature of the present invention to include a remote visual indicator of the separation between the fixed jaw and the bottom of the pitman, which determines the output material size setting.

It is another advantage of the present invention to provide for quick, easy and accurate hydraulic adjustment of the output material size setting.

The present invention is a hydraulically pre-loaded spring apparatus and method for adjusting the output material size setting of jaw-type crushers, designed to satisfy the aforementioned needs, provide the previously stated objects, include the above-listed features, and achieve the already articulated advantages. The present invention is carried out in a "wasted time-less" manner in a sense that the time required to manually release pressure on the tension rod hydraulic cylinder and the time required to check and maintain the proper pressure in the tension rod hydraulics, has been eliminated. The invention is also an accumulator-less system in the sense that a typical hydraulic accumulator which creates a "hydraulic spring" is not employed.

Accordingly, the present invention is a system and method including a jaw crusher which utilizes at least one of the following: an electronically controlled and/or automatically releasable hydraulic pre-loaded spring tension rod together, and a remote visual indicator of the output material size setting.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
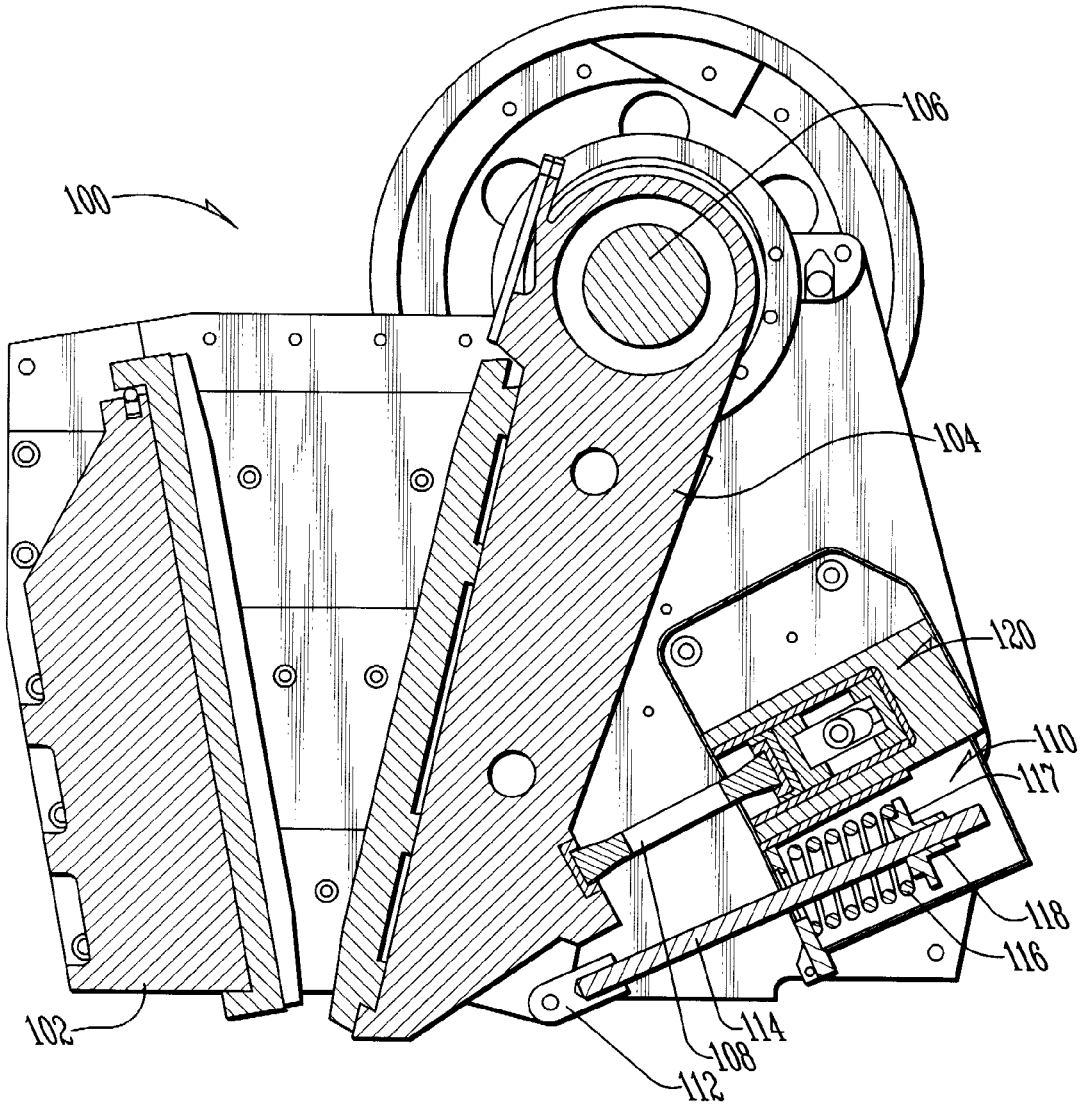
FIG. 1 Prior Art
FIG. 1 is a cross-sectional elevation view of a jaw crusher of the prior art, employing a spring-type tension rod and nut locking assembly.

Now referring to the drawings wherein like numerals refer to like matter throughout, and more specifically referring to FIG. 1, there is shown a jaw rock crushing system of prior art generally designated 100, including a fixed jaw 102 which typically is firmly mounted to a support structure. Pitman 104 is shown disposed next to fixed jaw 102. Pitman 104 is well known, and it moves around eccentric shaft 106. It is possible that a cam may be used instead of an eccentric shaft. It is also possible that in some situations, the fixed jaw 102 may be replaced with a second pitman. The discussion herein is focused upon a single pitman jaw crusher, but novel aspects of the present invention are intended to apply to crushers having multiple pitmans.

Pitman 104 is adjacent to toggle plate 108, which is adjacent to output material size setting adjusting wedge mechanism 120. Also shown is a tension rod assembly 110 having a tension rod to pitman connection 112, a tension rod 114, a tension rod spring 116, a tension rod end cap 117, and a tension rod adjusting nut 118.

Figure 2:
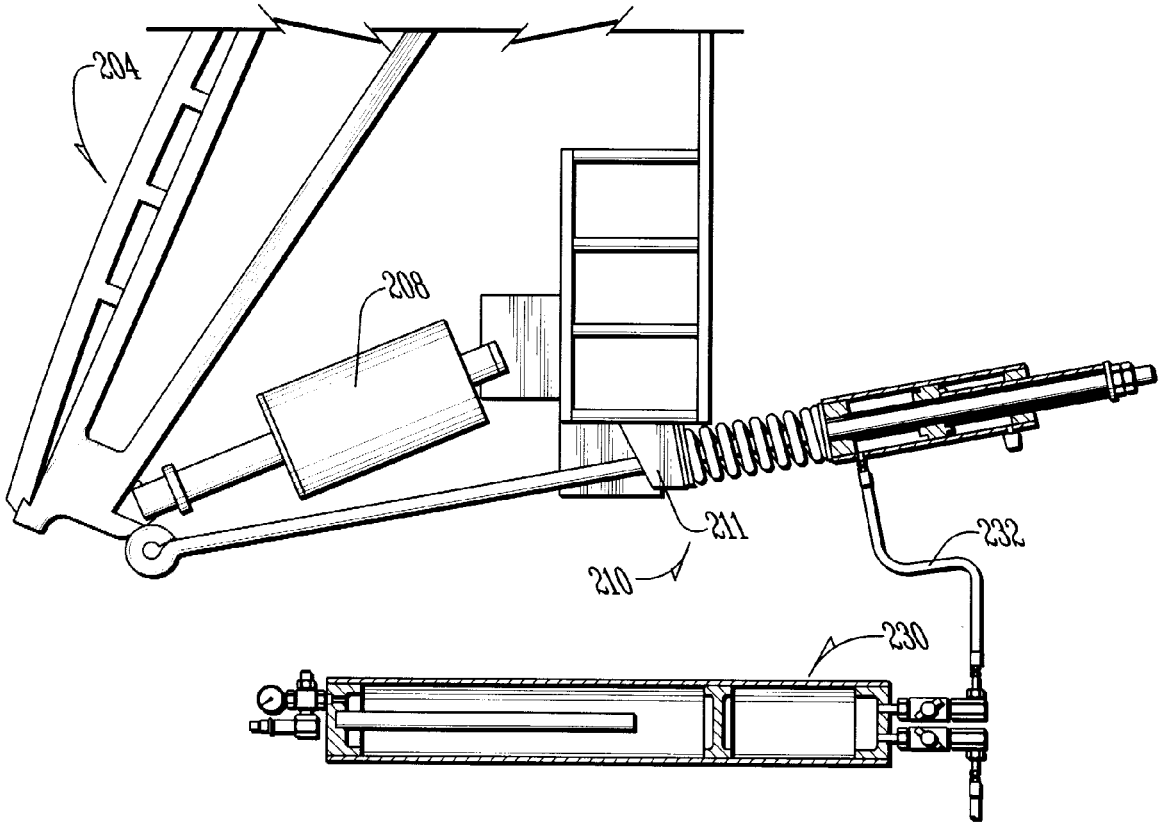
FIG. 2 Prior Art
FIG. 2 is a close-up elevational view of a hydraulic adjusting tension rod assembly of the prior art which shows an accumulator coupled to the tension rod by a hose or pipe.

Now referring to FIG. 2, there is shown a lower portion of a jaw crusher of the prior art, such as one made by Automatic Welding Machine and Supply Co. of Kitchener, Ontario Canada. FIG. 2 shows a pitman 204 and a toggle plate 208 which are believed to be functionally very similar to pitman 104 and toggle plate 108 respectively of FIG. 1. Also shown in FIG. 2 is a hydraulic spring tension rod assembly 210, which includes an accumulator 230 and an accumulator connection line 232. Note that this device has an attachment at one end to the pitman 204 and at a midpoint support 211, while the spring and hydraulic elements are located outside of the two support points for the hydraulic spring tension rod assembly 210.

Figure 3:
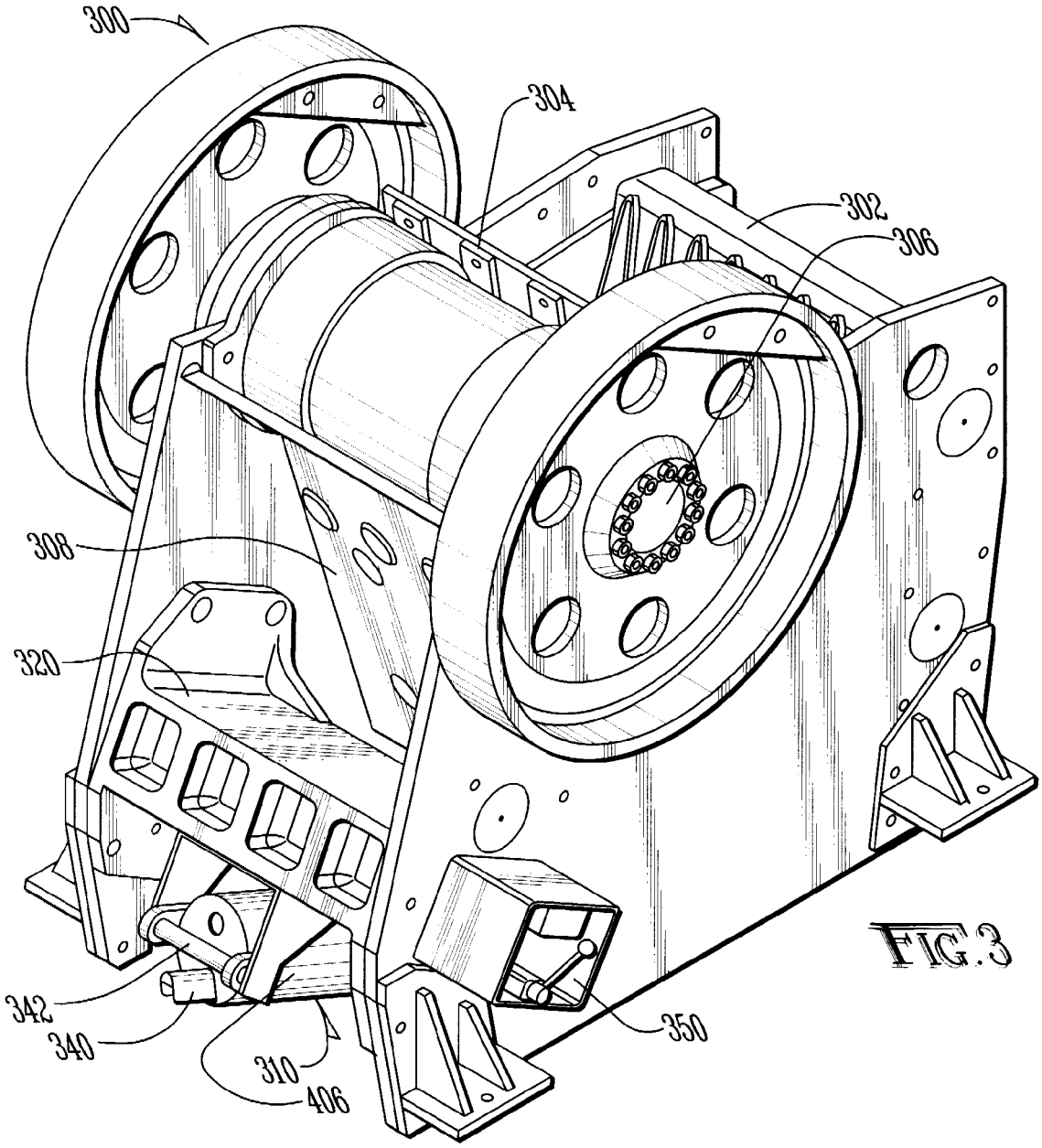
FIG. 3 is a perspective view of the jaw crusher of the present invention.

Now referring to FIG. 3, there is shown a jaw crusher of the present invention, generally designated 300, which includes a fixed jaw 302 and pitman 304. As stated above, the fixed jaw 302 may be replaced in some situations with a second pitman to achieve a dual pitman jaw crusher. It is the intention of the present invention to apply to multiple pitman jaw crushers as well. The pitman 304 is coupled to eccentric shaft 306 in a well-known manner. Also shown is toggle plate 308, as well as the outside end of the hydraulically preloaded spring tension rod assembly 310, which is shown below the output material size setting adjusting wedge mechanism 320. The hydraulically preloaded spring tension rod assembly 310 is shown having a tension rod assembly retaining pin 342, which is shown at the terminal end of hydraulically preloaded spring tension rod assembly 310. The location of the support of hydraulically preloaded spring tension rod assembly 310 at both ends thereof provides for some of the advantages of the present invention. The motion of the terminal end of the prior art device shown in FIG. 2 may be considered to be excessive. In the prior art design of FIG. 2, the terminal end will swing significantly because of the significant distance between its terminal end and the support 211. Shown adjacent to the hydraulically preloaded spring tension rod assembly 310 is remote visual indicator of output setting 340. The end of the rod of remote visual indicator of output setting 340 is shown protruding from the support structure at the end of the hydraulically preloaded spring tension rod assembly 310. The amount that this end protrudes indicates the crusher material gap or the output material size setting. This rod may have markings thereon which aid in measuring the extent of the protrusion and, therefore, the output material size setting. Also shown is hydraulic output adjusting controls 350 which are located in a position that the remote visual indicator of output setting 340 is easily visible when the hydraulic output adjusting controls 350 are being manipulated.

Figure 4:
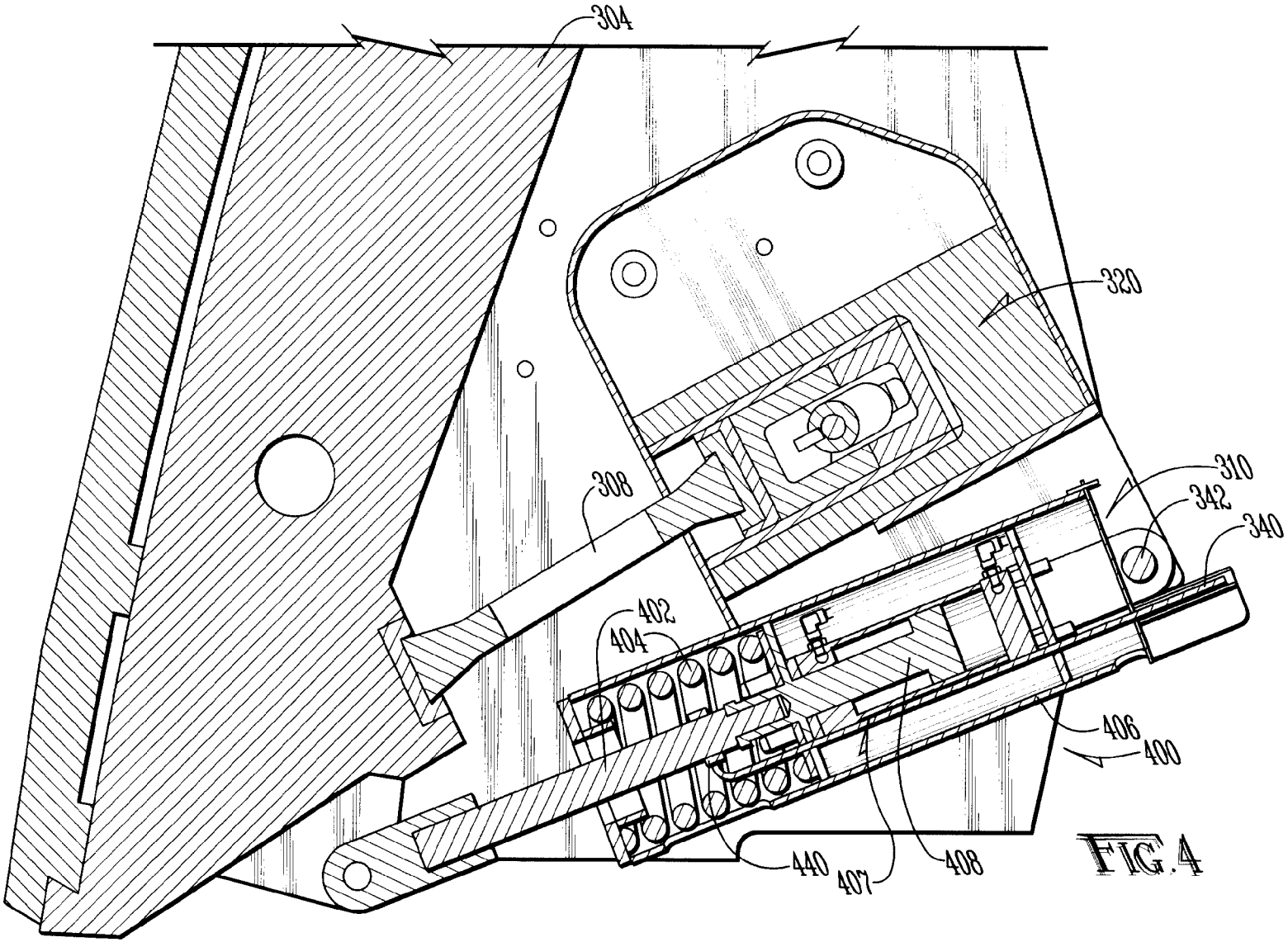
FIG. 4 is a close-up cross-sectional view of the lower portion of the jaw crusher of FIG. 3.

Now referring to FIG. 4, there is shown a close-up cross-sectional view of the lower portion of the crusher of the present invention, generally designated 400. The hydraulically preloaded spring tension rod assembly 310 is shown having a tension rod connecting rod 402 which couples to the pitman 304 and to the tension rod hydraulic pre-load piston 408. Also shown is the spring 404 which provides the desired tension force. The hydraulically preloaded spring tension rod assembly 310 has a tension rod assembly outside enclosure 406, which is coupled at one end via tension rod assembly retaining pin 342 to the frame of the crusher or in some embodiments, to the toggle plate 308 or the output material size setting adjusting wedge mechanism 320 or its support structure. Tension rod assembly outside enclosure 406 is a load bearing member as it structurally couples the pitman to a fixed location on the crusher, through the hydraulically preloaded spring tension rod assembly 310. Since the tension rod assembly outside enclosure 406 is a load bearing structure, the hydraulically preloaded spring tension rod assembly 310 would be inoperable if the tension rod assembly outside enclosure 406 were removed. This results in an advantageous increase in safety. Hydraulically preloaded spring tension rod assembly 310 includes a tension rod hydraulic pre-load mechanism 407 which is essentially a hydraulic cylinder which is adjusted to accommodate the differing location of the bottom of the pitman 304 when it is adjusted to different output material size settings by the toggle plate 308 and output material size setting adjusting wedge mechanism 320. The tension rod hydraulic pre-load mechanism 407 is capable of being released when necessary to facilitate ease of use of the output material size setting adjusting wedge mechanism 320.

The hydraulically preloaded spring tension rod assembly 310 is supported at one end by the pitman 304, and at the other end, by tension rod assembly retaining pin 342. The entirety of the hydraulically preloaded spring tension rod assembly 310 is located between these supports, and this eliminates any large protrusions which extend substantially beyond the end of the support structure associated with the hydraulically preloaded spring tension rod assembly 310.

Remote visual indicator of output setting 340 is shown coupled at visual indicator connection point 440 to the tension rod connecting rod 402. The displacement of the spring does not affect the location of the end of the rod of the remote visual indicator of output setting 340.

Figure 5:
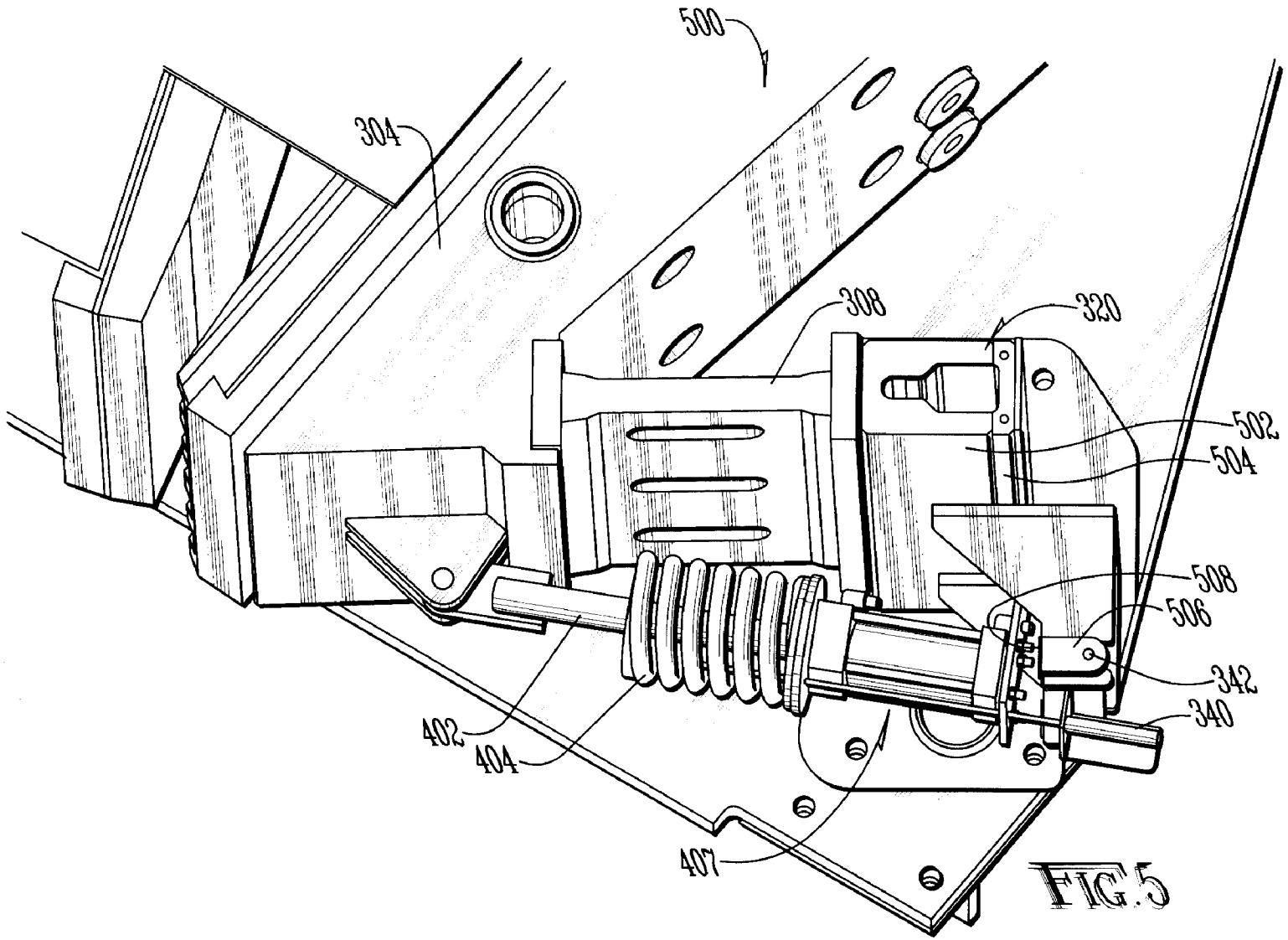
FIG. 5 is a partially cut-away perspective view of the lower portion of the jaw crusher of FIG. 3.

Now referring to FIG. 5, there is shown an alternate view of the crusher of the present invention, generally designated 500. In FIG. 5, the tension rod assembly outside enclosure 406 has been removed, as well as a cover on output material size setting adjusting wedge mechanism 320 so as to expose the underlying mechanisms. Shown are output material size adjusting first wedge 502 and output material size adjusting second wedge 504. The cylinder to actuate these wedges is smaller than in many prior art crushers and is located with the structure labeled as output material size setting adjusting wedge mechanism 320.

One of the advantages of the present invention is achieved by the use of tension rod assembly deformable retaining clip 506 which couples to tension rod assembly retaining pin 342 and fits in a slot in the support structure. Tension rod assembly deformable retaining clip 506 has a tension rod assembly deformable retaining clip back end 508 which extends behind the support structure. However, if the toggle plate 308 is collapsed and excessive forces are applied to hydraulically preloaded spring tension rod assembly 310, the tension rod assembly deformable retaining clip back end 508 will bend straight, and the hydraulically preloaded spring tension rod assembly 310 will drop out of the slot. This dropping out of the slot will prevent expensive damage to the hydraulically preloaded spring tension assembly 310 and also will be apparent to the operator, who can shut down the crusher and make necessary repairs and replacements.

Figure 6:
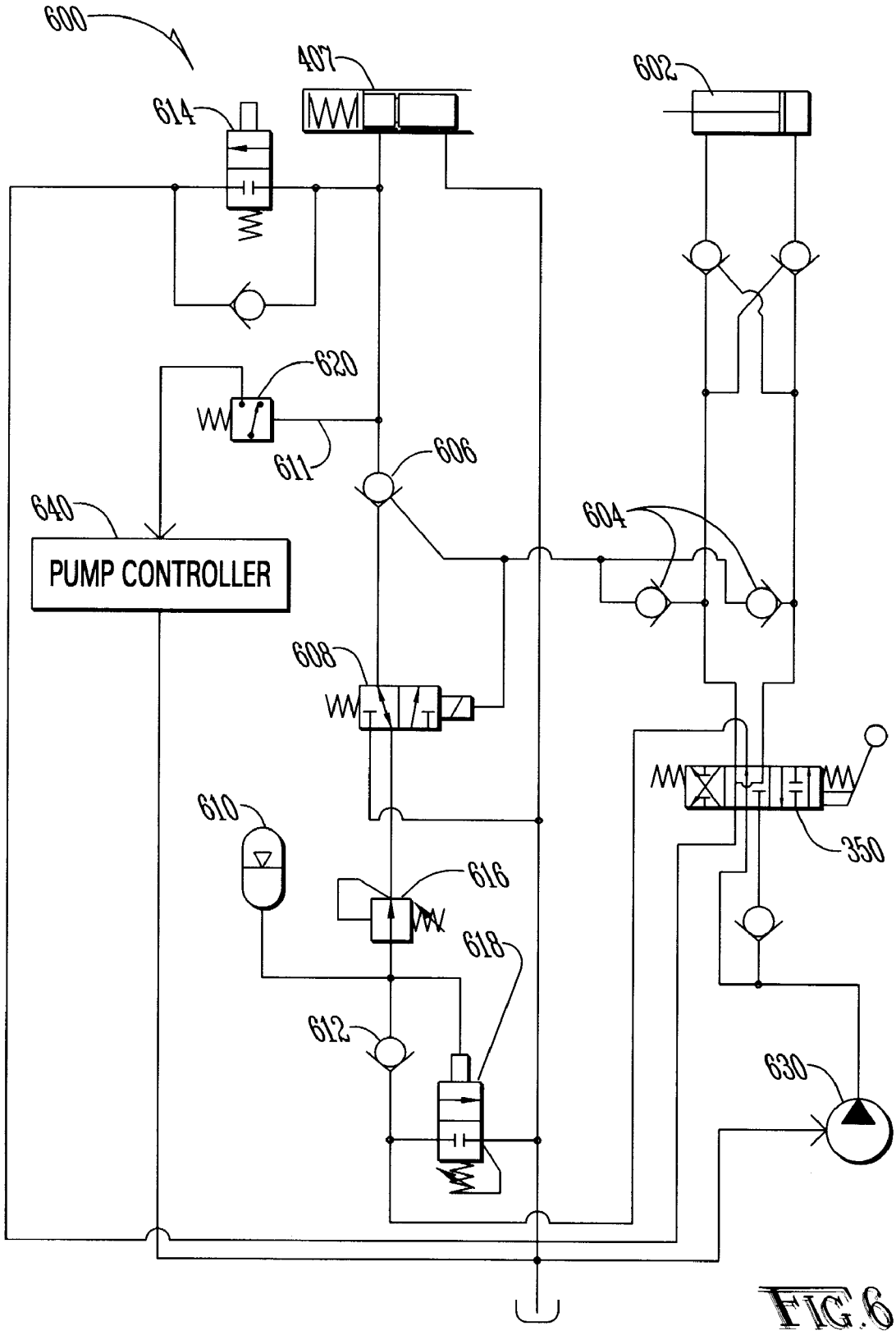
FIG. 6 is a schematic circuit diagram of the hydraulic and electrical systems of the present invention.

Now referring to FIG. 6, there is shown a schematic diagram of the hydraulics of the present invention, generally designated 600. Hydraulic output adjusting controls 350 are shown, as well as high pressure sensitive check valves 604, which are hydraulically coupled to pilot to open check valve 606 and flow diverting valve 608, which are triggered by the pressure associated with high pressure sensitive check valve 604 but release the pressure associated with the tension rod hydraulic pre-load mechanism 407. The wedge manipulating hydraulic cylinder 602 is shown as well. It can be readily seen that when the wedge manipulating hydraulic cylinder 602 is actuated by hydraulic output adjusting controls 350, the high pressure associated with that actuation is applied via high pressure sensitive check valves 604 to the pilot to open check valve 606 and flow diverting valve 608 which release the pressure on the tension rod hydraulic pre-load mechanism 407, thereby making it easier for wedge manipulating hydraulic cylinder 602 to move the wedges.

Also shown is the optional accumulator 610 which performs the function of providing for a more constant pressure in line 611 as a result of leaks, etc. without the need to command the pump 630 to adjust for every detected pressure drop. The structure which performs this function may be a hydraulic/pneumatic accumulator as is well known in the art or a suitable substitute.

Also shown is the accumulator isolating check valve 612 which performs the function of allowing the accumulator 610 to maintain the pressure in line 611 without bleeding the pressure in the accumulator 610 out to the pump 630. The structure which performs this function may be a simple check valve with a predetermined pressure level needed to keep it closed or open, depending upon the particular arrangement of components or a suitable substitute.

Also shown is the manual pressure release valve 614 which performs the function of releasing pressure in the cylinder of mechanism 407 during servicing. The structure which performs this function may be a plunger operated check valve or a suitable substitute.

Also shown is the adjustable pressure reducing valve 616 which performs the function of setting the desired pre-load on tensioning mechanism 407. The structure which performs this function may be a pressure reducing valve or a suitable substitute.

Also shown is the unloading valve 618 which performs the function of diverting pump flow, after the tensioning cylinder is loaded, instead of continuing to build pressure, so as to reduce horsepower requirements. The structure which performs this function may be a pilot actuated spool valve or a suitable substitute.

Also shown is the pressure sensing device 620 which performs the function of measuring and aiding in the reporting of the pressure in the hydraulic line 611. The structure which performs this function may be a pressure transducer which generates an electronic signal representative of the pressure in line 611, or it may be a similar sensing apparatus, or it may even be a pressure gauge which provides a visual indication of the pressure in line 611 to a human operator of the system of the present invention.

The pressure sensing device 620 provides its electronic output signal on line 622 to electronic controller 640.

Electronic controller 640 performs the function of receiving information relating to the pressure in line 611 and other lines if so desired, and generating a command on line 642 to drive the pump 630 to increase the pressure in line 611.

Electronic controller 640 may be the microprocessor as mentioned herein, or it may be an electronic device with more limited capabilities such as a gate array or other dedicated circuitry to perform the limited functions of maintaining pressure in line 611 within certain predetermined limits and disabling the entire jaw crusher if so desired.

It should be understood that not all of the advantages of the present invention require the use of an electronic controller 640. Indeed some of the advantages of the present invention can be achieved with an embodiment where the pressure sensing device is a gauge, and a human operator inspects the gauge and controls a pump in response to the pressure indicated by the gauge.

The linkages herein are described as being hydraulic linkages; however, it is contemplated that other types of linkages could be substituted, such as mechanical, electrical, pneumatic, or a combination thereof.

The term "pre-load" is used herein to refer to the application of hydraulic forces to address the differing location of the hydraulically preloaded spring tension rod assembly 310, depending upon the output material size setting.

The term "pitman" is used herein, as it is well known in the rock crushing industry, to mean the moving jaw in a jaw crusher which moves around in an eccentric path. This definition is not necessarily intended to be consistent with the usage of the term in the automotive industry, where it often refers to a connecting rod.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A jaw rock crusher comprising:

a first jaw;

a pitman;

means to cyclically move the pitman along an eccentric path;

a toggle plate disposed adjacent said pitman on an opposite side from said first jaw;

a means for adjusting a location of said pitman so as to control a maximum size of material which is permitted to pass between said fixed jaw and said pitman;

a tension rod assembly coupled to said pitman and configured to create a force which is biased toward increasing contact between said pitman and said toggle plate;

said tension rod assembly comprising a spring which is displaced during operation of the means to cyclically move the pitman; and an indicator disposed remotely with respect to a gap between said first jaw and a bottom portion of said pitman, said indicator configured to provide an indication of a separation distance between said first jaw and said bottom portion of said pitman, while simultaneously providing an indication of operation of the means to cyclically move the pitman.

2. A jaw crusher of claim 1 wherein said indicator comprises an elongated member coupled to a portion of said tension rod assembly which correspondingly moves in response to cyclical movement of the pitman during an operational phase of use of the jaw crusher when rocks are being crushed and adjustments to an output size setting are not being made.

3. A jaw crusher of claim 2 wherein said tension rod assembly comprises a hydraulically actuated member.

4. A jaw crusher of claim 3 wherein said tension rod assembly comprises a means to preload pressure on a compression spring.

5. A jaw crusher of claim 4 wherein said elongated member comprises graduated markings disposed thereon which indicate a separation distance between the first jaw and the pitman.

6. A jaw crusher of claim 1 wherein an elongated member comprises graduated markings disposed thereon which indicate a separation distance between the first jaw and the pitman.

7. A jaw crusher of claim 1 wherein said indicator comprises an elongated rigid member coupled to the tension rod assembly.

8. A jaw crusher of claim 7 wherein said elongated rigid member extends out a rear end of the tension rod assembly.

9. A jaw crusher comprising:

means for limiting a movement of a rock to be crushed;

means for crushing a rock by pressing the rock against said means for limiting;

an eccentric shaft coupled to said means for crushing, where rotation of said shaft results in motion of said means for crushing;

means for adjusting permissible motion of said means for crushing; and means solely for remotely indicating a separation distance between a portion of said means for limiting and a portion of said means for crushing, wherein said means for remotely indicating provides a visual indication of an output material size setting which is determined by said means for adjusting;

and said means for remotely indicating comprising an elongated rod.

10. The jaw rock crusher of claim 9 wherein said means for remotely indicating further comprising:

said elongated rod having a free end which moves in unison with a portion of said means for crushing; and wherein movement of said elongated rod results in relative movement between a series of graduated marks and an adjacent reference mark.

11. The jaw crusher of claim 9 wherein said elongated rod is a rigid elongated rod.

12. A method of crushing rock with a jaw crusher comprising the steps of:

providing a first jaw;

providing a pitman coupled to an eccentric shaft;

providing a toggle plate disposed adjacent to said pitman;

providing a means to limit a location of the toggle plate;

manipulating, from an output control location, the output material size setting of the material output between the first jaw and the pitman by manually actuating the means to limit movement of the toggle plate, while simultaneously viewing relative movement between graduated markings and a reference, from the output control location, on a visual indicator, which relative movement is representative of changes in a remotely located variable gap between the pitman and the first jaw.

13. A method of crushing rock of claim 12 further comprising the steps of:

providing a tension device which comprises a spring and a hydraulic device to apply a pre-load to said spring.

14. A method of crushing rock of claim 12 further comprising the steps of automatically reducing a tension between said pitman and said toggle plate when manually actuating the means to limit movement of the toggle plate so as to move said pitman closer to said first jaw.

15. A method of crushing rock with a jaw crusher comprising the steps of:

providing a first jaw;

providing a pitman coupled to an eccentric shaft;

providing a toggle plate disposed adjacent to said pitman;

providing a means to limit a location of the toggle plate;

manipulating, from an output control location, the output material size setting of the material output between the first jaw and the pitman by actuating the means to limit movement of the toggle plate, while simultaneously viewing relative movement between graduated markings and a reference, from the output control location, on a visual indicator, which relative movement is representative of changes in a remotely located variable gap between the pitman and the first jaw.

16. The method of claim 15 wherein said steps of simultaneously viewing relative movement between graduated markings and a reference comprises the step of viewing a protuberance extending beyond a rear end of a hydraulically preloaded spring.

17. The method of claim 15 wherein said steps of simultaneously viewing relative movement between graduated markings and a reference comprises the step of viewing a translating elongated member coupled to a portion of a tension rod assembly.

18. A jaw rock crusher comprising:

a first jaw;

a pitman;

an eccentric shaft coupled to said pitman;

a toggle plate disposed adjacent said pitman on an opposite side from said first jaw;

a means for adjusting a location of said pitman so as to control a maximum size of material which is permitted to pass between said fixed jaw and said pitman;

a spring tension rod comprising a spring and a rod coupled to said pitman and configured to create a force which is biased toward increasing contact between said pitman and said toggle plate;

said spring tension rod having a hydraulic piston coupled thereto for pre-loading said spring, so that said force may be maintained at a predetermined level irrespective of a setting location of said pitman as determined by said means for adjusting;

said hydraulic piston having coupled thereto a path of hydraulic fluid to a source of hydraulic fluid at an adjustable pressure;

a pressure sensor configured to measure a fluid pressure characteristic which is indicative of a pressure in said path of hydraulic fluid;

a means for automatically releasing pressure in said path of hydraulic fluid in response to an initiation of an adjustment of said means for adjusting;

said means for automatically releasing pressure is responsive to an increase in hydraulic pressure which causes a manipulation of a location of said toggle plate;

wherein said means for automatically releasing pressure is a pressure-relieving device which is responsive to a high pressure in a line other than said path of hydraulic fluid;

a check valve in said line other than said path of hydraulic fluid, where said check valve applies a high pressure to manipulate a pilot to open check valve and flow diverting valve when said means for adjusting moves a wedge;

a pressure sensor configured to measure a fluid pressure characteristic which is indicative of a pressure in said path of hydraulic fluid and a source of variable pressure hydraulic fluid;

wherein said source of variable pressure hydraulic fluid comprises a pump and an electronic pump controller;

wherein said electronic pump controller is a microprocessor which commands pump activity in response to a measurement of said fluid pressure characteristic which measurement is below a predetermined lower limit;

wherein said microprocessor generates a signal which terminates rotation of said eccentric shaft in response to said measurement of said fluid pressure exceeding a predetermined upper limit; and an indicator disposed remotely with respect to a gap between said first jaw and a bottom portion of said pitman, said indicator configured to provide an indication of a separation distance between said first jaw and said bottom portion of said pitman.

* * * * *